US008353808B1

(12) United States Patent
Barney

(10) Patent No.: US 8,353,808 B1
(45) Date of Patent: Jan. 15, 2013

(54) MULTI-DIRECTIONAL ROLLING ABDOMINAL EXERCISE DEVICE

(76) Inventor: Edwin Michael Barney, New Town Sq., PA (US)

( * ) Notice: Subject to any disclaimer, the term of this patent is extended or adjusted under 35 U.S.C. 154(b) by 0 days.

(21) Appl. No.: 13/524,089

(22) Filed: Jun. 15, 2012

(51) Int. Cl.
*A63B 22/20* (2006.01)
*A63B 23/02* (2006.01)
*A63B 21/068* (2006.01)

(52) U.S. Cl. ..... 482/132; 482/51; 482/96; 482/140; 482/141; 482/907

(58) Field of Classification Search ..... 482/51, 482/79, 80, 95, 96, 132, 140, 141, 145–148, 482/907; 280/28.5, 87.041, 87.021, 87.01, 280/87.042, 205, 843
See application file for complete search history.

(56) References Cited

U.S. PATENT DOCUMENTS

| | | | | |
|---|---|---|---|---|
| 693,064 | A * | 2/1902 | Proben et al. | 601/129 |
| 1,271,891 | A * | 7/1918 | Gustin | 280/843 |
| 6,053,853 | A * | 4/2000 | Hinds | 482/132 |
| 6,582,347 | B2 * | 6/2003 | Smith | 482/140 |
| 6,942,605 | B1 * | 9/2005 | Sukhovitsky | 482/132 |
| 7,285,080 | B1 | 10/2007 | Chiu | |
| 7,604,581 | B1 * | 10/2009 | Williams | 482/140 |
| 7,621,858 | B2 * | 11/2009 | Sheron | 482/132 |
| 7,658,700 | B2 * | 2/2010 | Maloy et al. | 482/132 |
| 7,993,250 | B2 | 8/2011 | Abbot | |
| 2002/0070514 | A1 * | 6/2002 | Costa et al. | 280/11.226 |
| 2007/0010384 | A1 * | 1/2007 | Roberts | 482/140 |
| 2007/0298947 | A1 * | 12/2007 | Eksteen | 482/141 |
| 2010/0261590 | A1 * | 10/2010 | Fares | 482/131 |
| 2011/0160024 | A1 | 6/2011 | Candela et al. | |
| 2012/0252645 | A1 * | 10/2012 | Agostini | 482/132 |

FOREIGN PATENT DOCUMENTS

CN 202173722 U * 3/2012

* cited by examiner

*Primary Examiner* — Loan Thanh
*Assistant Examiner* — Victor K Hwang
(74) *Attorney, Agent, or Firm* — IP & Internet Law North LLC; Thomas Lizzi

(57) ABSTRACT

Exercise devices for exercising the abdominal muscles and other muscle groups are disclosed. Each of the exercise devices has a housing from which opposing interconnected ends of an axle extend and a support ball that is captured within and partially extends from the housing. The housing has a cavity defining a partial sphere for receiving the support ball. Each of the exercise devices also comprises a plurality of strips which are attached to the surface of the cavity. Each of the strips includes a plurality of bearings each of which is captured within a bearing race. The strips are positioned upon the cavity surface so as to engage the support ball surface and to provide free-rolling support of the housing on the support ball in any direction when the exercise device is in use. Methods of using the exercise devices are also disclosed.

16 Claims, 6 Drawing Sheets

MULTI-DIRECTIONAL ROLLING ABDOMINAL EXERCISE DEVICE

BACKGROUND

1. Field of the Invention

The present invention relates to a single user, portable exercise device for exercising the abdominal muscles and other muscle groups.

2. Background of the Invention

The muscles of the human abdomen are a strong indicator of health and fitness. These muscles support nearly every movement of the body, assisting posture, maintaining balance, and permitting spine mobility. Each breath is supported by abdominal muscles and internal organs are protected by these core muscles. In addition to providing these functions, a well toned stomach is considered visually appealing. Because of the benefits from having strong stomach muscles, a wide variety of exercises and exercise devices exist to strengthen this core muscle group.

Exercise devices targeted toward abdominal exercises include abdominal chairs, rollers, sliders, and exercise balls. Many of these devices only permit a limited range of motion by the user, such as extending the torso out in one direction and returning along the same direction. Exercise with such devices can be effective in developing or toning the rectus abdominus muscle, which some fitness enthusiasts sculpt into what are sometimes colloquially referred to as "six-pack abs," but such exercise is less effective for developing or toning other muscles or muscle groups, including the abdominal muscles which are involved with lateral movement and rotation. It is therefore desirable to have an exercise device capable of lateral movement and which can incorporate a wide variety of exercises to strengthen multiple muscle groups.

An example of an exercise device that is designed for exercising a user's abdominal muscles is disclosed in U.S. Pat. No. 7,993,250 to Abbott. The Abbott exercise device comprises a large pliable support ball having handles diametrically extending therefrom. The handles are rotatably supported on a shaft that runs through the center of the support ball. The Abbott exercise device has the disadvantage that the support ball rotates only in the direction that is perpendicular to its handles.

An exercise device which purports to enable a user to have multiple ranges of motion during abdominal exercise is described in U.S. Patent Application No. 2011/0160024 of Candela. The Candela exercise device has a partially exposed support ball captured within a housing, and two handles extending from the housing. The support ball is retained within the housing by a collar. Loose ball bearings are disposed in a space between the housing and the support ball. The operability of the Candela exercise device suffers from the fact that these ball bearings are free to move about within the cavity and to collect in the collar region at the bottom of the cavity. This, in turn, may result in the top of the support ball binding against the inside of the housing. Also, the free-wandering ball bearings may intermittently bunch up and bind together, resulting in unpredictable operation of the Candela exercise device. The handles are removable, making the subject to being lost, but are locked immovably in place to small protrusions on opposite sides of the housing. When the user applies his or her body weight to the handles, the resulting torque exerted by the handles on the housing protrusions tends to cause the housing to pinch inward against the ball bearings and the support ball possibly causing binding of the support ball. Such binding will interfere with the overall movement of the exercise device. Another drawback of the Candela exercise device is the large size of its support ball which requires the housing to be large.

In our health conscious, mobile society there is a need for a better portable device capable of multi-directional movement and consistent operation for exercising the entire abdominal core and other muscle groups.

SUMMARY OF THE INVENTION

The present invention provides exercise devices for exercising the abdominal muscles and other muscle groups. The inventive exercise devices are of the type that are, during use, meant to be engaged by or between two limbs of a user, e.g., two hands, two feet, two knees, two elbows, etc., and rolled around the floor or some other surface while another portion of the user's body, e.g., the feet, knees, or hands, is otherwise maintained in place on, e.g., the floor, a chair, a bench, an exercise ball, etc. Each of the inventive exercise devices comprises a housing from which opposing interconnected ends of an axle extend and a support ball that is captured within and partially extends from the housing. The housing has a cavity defining a partial sphere for receiving the support ball. Each of the inventive exercise devices also comprises a plurality of strips which are attached to the surface of the cavity. Each of the strips includes a plurality of bearings each of which is captured within a bearing race. The strips are positioned upon the cavity surface so as to engage the support ball surface and to provide free-rolling support of the housing on the support ball in any direction when the exercise device is in use. The support ball has a diameter that is in the range of from about 3 to about 5.5 inches and an outer surface that is adapted to rollingly grip, rather than slip upon, conventional flooring surfaces.

Each of the inventive exercise devices preferably also includes a retaining element having an opening through which the support ball cleanly extends when the retaining element is attached to the housing and the support ball is supporting the housing. The opening in the retaining element is sized so that the support ball remains within the housing cavity when the inventive exercise device of which it is a part is lifted off of the floor.

In some preferred embodiments, each of the inventive exercise devices also comprises an axle yoke having a pair of diametrically opposed elongate elements extending from a center portion which has a central opening. The central portion of the axle yoke is attached to or contained within the housing so that each of the axle yoke's elongate elements either form, at least in part, or are operably connected to one of the handles of the inventive exercise device.

In some preferred embodiments, each of the ends of the axle has a handle. More preferably, each of the handles comprises a support platform. In some such preferred embodiments, the support platform comprises a receptacle adapted to receive the user's knee cap or elbow.

In some preferred embodiments, the handles of the inventive exercise device provide rotatable support for a limb of the user.

In some preferred embodiments, each of the inventive exercise devices is designed so that when the support ball is on the floor and the housing is tilted to cause one of its handles to contact the floor, the angle formed by the floor and a handle is at least 35 degrees. In more preferred embodiments, this floor contact tilt angle is at least 40 degrees.

The present invention also includes methods of exercising with the inventive exercise devices. In such method embodiments, the inventive exercise device is rolled about a use surface, e.g., a floor, while being engaged by portions a pair of the user's limbs, e.g., the user's hands, elbows, knees, or feet.

BRIEF DESCRIPTION OF THE DRAWINGS

The criticality of the features and merits of the present invention will be better understood by reference to the attached drawings. It is to be understood, however, that the drawings are designed for the purpose of illustration only and not as a definition of the limits of the present invention. Unless otherwise specified, the drawings are not to scale. It is also to be understood that, for sake of clarity, the drawings are presented as schematics in which some features are omitted from individual drawings.

DESCRIPTION OF PREFERRED EMBODIMENTS

In this section, some preferred embodiments of the present invention are described in detail sufficient for one skilled in the art to practice the present invention. It is to be understood, however, that the fact that a limited number of preferred embodiments are described herein does not in any way limit the scope of the present invention as set forth in the appended claims. It is also to be understood that whenever a range of values is presented, the range is to be construed as disclosing its endpoints and every point therebetween as if each point was expressly described.

Figure 1:
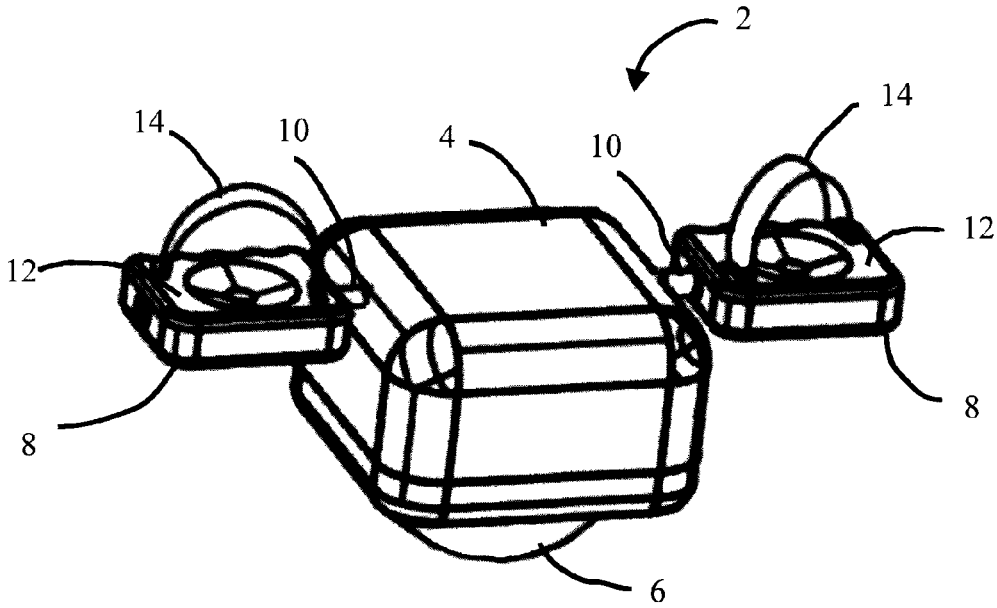
FIG. 1 is a perspective view of an exercise device in accordance with a first embodiment of the present invention.

Referring to FIG. 1, there is shown a perspective view of an exercise device 2 according to a first embodiment of the present invention. The exercise device 2 includes a housing 4 containing and supported during use by a support ball 6. Two collinear handles 8 are rotatably supported by an axle 10 the ends of which extend out through opposite sides of the housing 4. Each of the handles 8 includes a support platform 12 and an adjustable strap 14.

Figure 2:
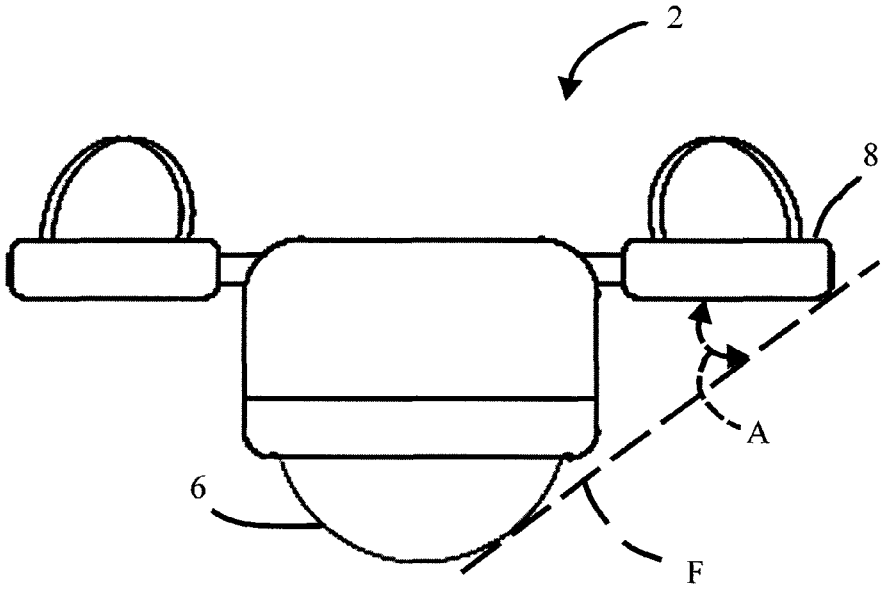
FIG. 2 is a side elevational view of the exercise device of FIG. 1.

Referring now to FIG. 2, there is shown a side elevational view of the exercise device 2. The dashed line F, which is tangent to the support ball 6 and the handle 8, represents the floor when the exercise device 2 is tilted in use so that the handle 8 contacts the floor. Preferably, the exercise device is proportioned so that the tilt angle A between the floor and the handle 8 is at least 35 degrees and is more preferably at least 40 degrees so that the exercise device can be tilted during use to allow the user to engage muscle groups that would otherwise not be exercised with lesser amounts of tilt.

Figure 3:
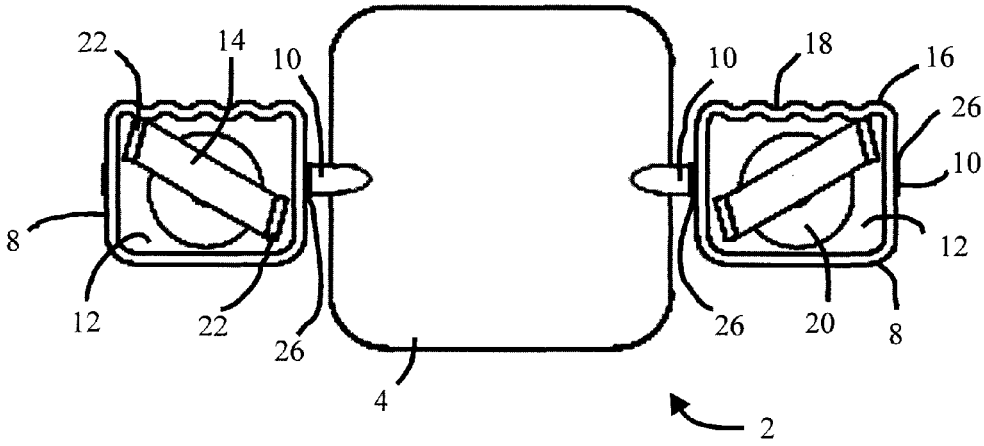
FIG. 3 is a top plan view of the exercise device of FIG. 1.

Referring now to FIG. 3, there is shown a top plan view of the exercise device 2. Each of the support platforms 12 of the handles 8 preferably has along its front edge 16 a plurality of grooves 18 for receiving a user's fingers. Each of the support platforms 12 also has an indentation 20 which is adapted to accommodate the user's kneecap or elbow. Each support platform 12 also has a pair of slots 22 for receiving a portion of the adjustable strap 14. Preferably, the each of the support platforms 12 comprises a padding material to provide for the user's comfort.

Figure 4:
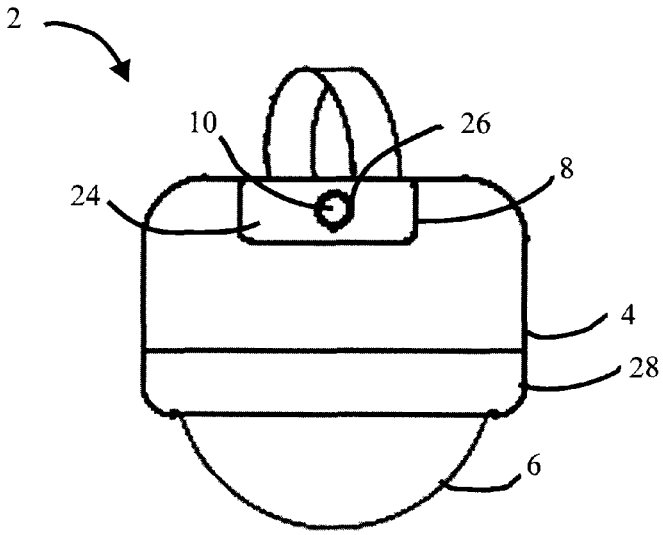
FIG. 4 is an end elevational view of the exercise device of FIG. 1.

FIG. 4 shows an end view of the exercise device 2. Referring now to FIGS. 3 and 4, the end of the axle 10 extends slightly out from the end face 24 of the handle 8. Clips 26, which engage the axle 10 on either side of the handles 8, retain the handles 8 in place upon the axle 10 while permitting the handles 8 to rotate on the axle 10.

Referring to FIG. 4, a retaining element 28 is attached to the lower end of the housing 4. The retaining element 28 has an opening 30 (see FIG. 5A) through which the support ball 6 extends cleanly, i.e., without interference, when the exercise device 2 is in use. The opening in the retaining element 28 is sized so that when the exercise device 2 is lifted from the floor, the support ball 6 is lifted along with the rest of the exercise device 2.

Figure 5A:
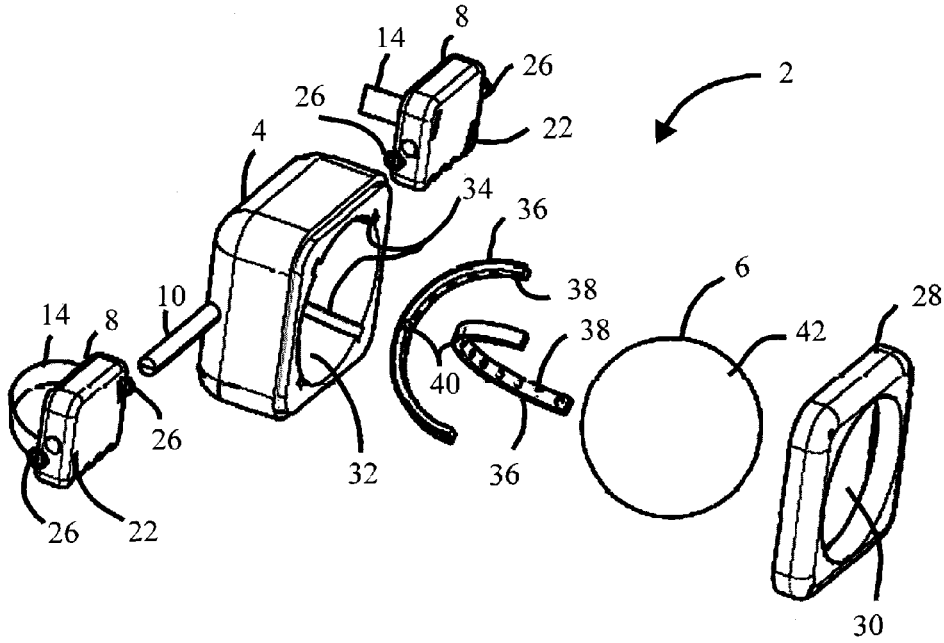
FIG. 5A is an exploded view of the exercise device of FIG. 1.
Figure 5B:
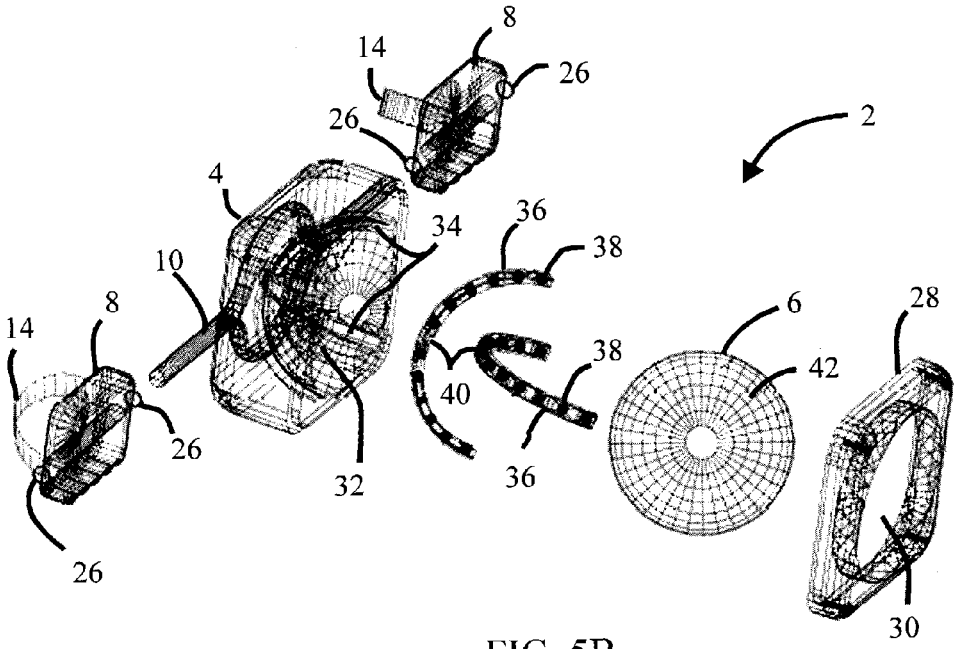
FIG. 5B is wire-mesh version of the exploded view of FIG. 5A.

Except for some of the fasteners, e.g., screws, all of the individual components of the exercise device 2 are show in FIGS. 5A and 5B. FIG. 5A shows a solid exploded view of the exercise device 2 and FIG. 5B shows a wire mesh exploded view of the exercise device 2. The wire mesh view of FIG. 5B is helpful to the understanding of the exercise device 2 since, in essence, it shows the location of some of the components within the housing 4 and the handles 8.

Referring now to FIGS. 5A and 5B, it can be seen that the housing 4 has a cavity 32 for receiving the support ball 6. The cavity 32 is in the shape of a partial sphere for receiving the support ball 6 and its surface has two grooves 34. The grooves 34 are adapted to receive and retain two ball bearing assembly strips 36, e.g., by interference fit, fasteners, or adhesive. Each of the ball bearing assembly strips 36 comprises a plurality of ball bearings 38 each of which is rotatably captured within a race. Each of the ball bearing assembly strips 36 has a notch 40 to permit the overlapping disposition of the ball bearing assembly strips 36 within the grooves 34. During use of the exercise device 2, the ball bearings 38 contact the outer surface 42 of the support ball 6 so that the housing 4 has free-rolling support upon the support ball 6. This allows the user to freely roll the exercise device 2 in any direction along the floor or other use surface. The support ball 6 is captured within the cavity 32 by a retaining element 28. The retaining element 28 may be permanently or removably attached to the housing 4, e.g. by interference fit, fasteners, or adhesive.

Figure 6:
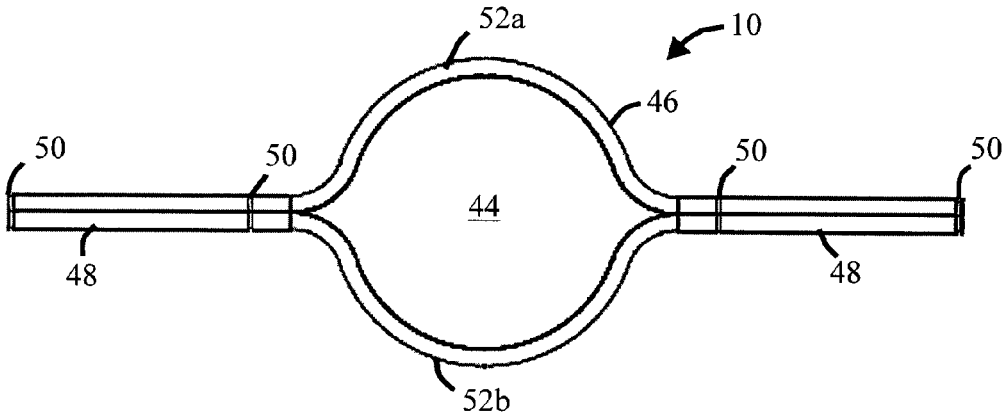
FIG. 6 is a top plan view of handle yoke of the exercise device of FIG. 1.

The axle 10 of the exercise device 2 may be in the configuration of a straight rod or pipe. More preferably, however, the axle 10 is configured as a yoke as it is in the exercise device 2. FIG. 6 shows a top plan view of the axle 10 which is part of the exercise device 2 that is depicted in FIGS. 5A and 5B. The axle 10 has an opening 44 in its circular central portion 46 and two elongate elements 48 diametrically extending therefrom. Two grooves 50 are provided in each of the elongate elements 48 and are positioned to be on either side of a handle 8 and are configured to receive clips 26 for rotatably confining the handles 8 in place on the axle 10. Although in this embodiment the axle 10 is shown as comprising two formed elongate members 52*a*, 52*b*, the axle 10 may be formed of a single piece or of more than two pieces so long as the axle 10 has the same overall configuration and is capable of rotatably supporting the handles 8 during use. It is to be understood that the elongate members 52*a*, 52*b* may be may be attached to one another, e.g., by a fastener or by welding, but also may be independent though held together by over-fitting handles 8 and/or the housing 2. The central portion 46 of the axle 10 distributes the user's weight across a larger portion of the housing 4 than does an axle which is configured as a straight rod or pipe. Preferably, the housing 4 is injection molded with the axle 10 in place or the housing 4 is made to have an upper portion and lower portion which are subsequently fastened together with the axle 10 captured between them.

Figure 7:
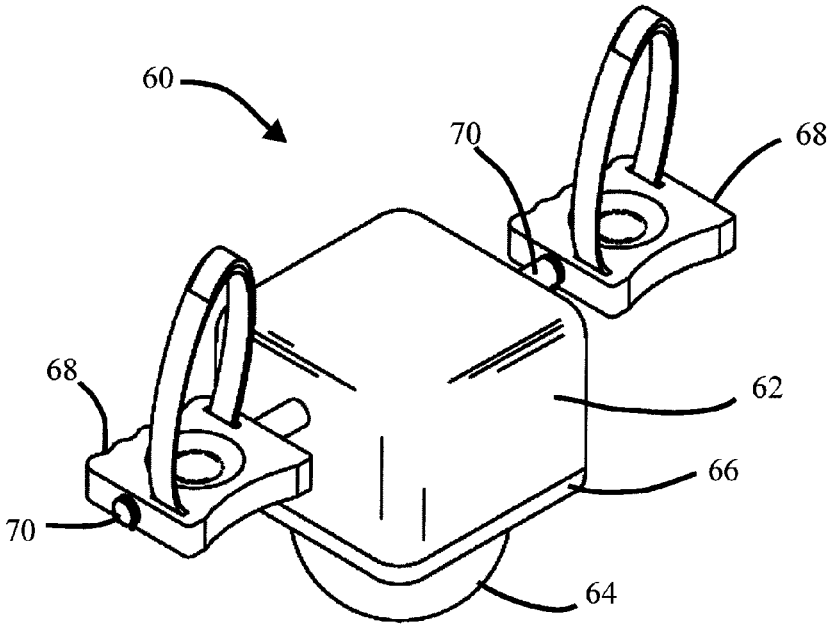
FIG. 7 is a perspective view of an exercise device in accordance with a second embodiment of the present invention.

Referring now to FIG. 7, there is shown a perspective view of an exercise device 60 according to a second embodiment of the present invention. The exercise device 60 is similar in many respects to the exercise device 2 described above. The exercise device 60 includes a housing 62 which contains and is supported by a support ball 64 and a retaining element 66 for retaining the support ball in the housing 62 when the exercise device 60 is lifted from the floor. It also includes a pair of collinear handles 68 which are rotatably supported on opposite ends of an axle 70 the ends of which extend out from opposite sides of the housing 62.

Figure 8A:
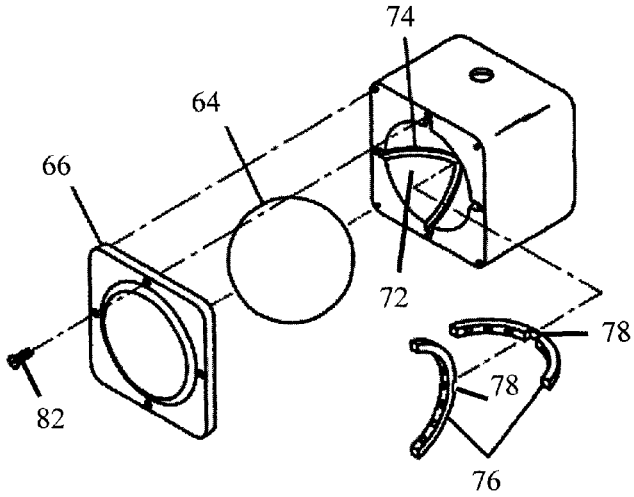
FIG. 8A is an exploded view of portion of the exercise device of FIG. 7.
Figure 8B:
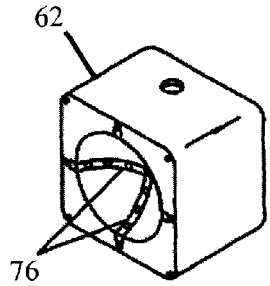
FIG. 8B is a perspective view of the housing portion of the exercise device of FIG. 7.
Figure 8C:
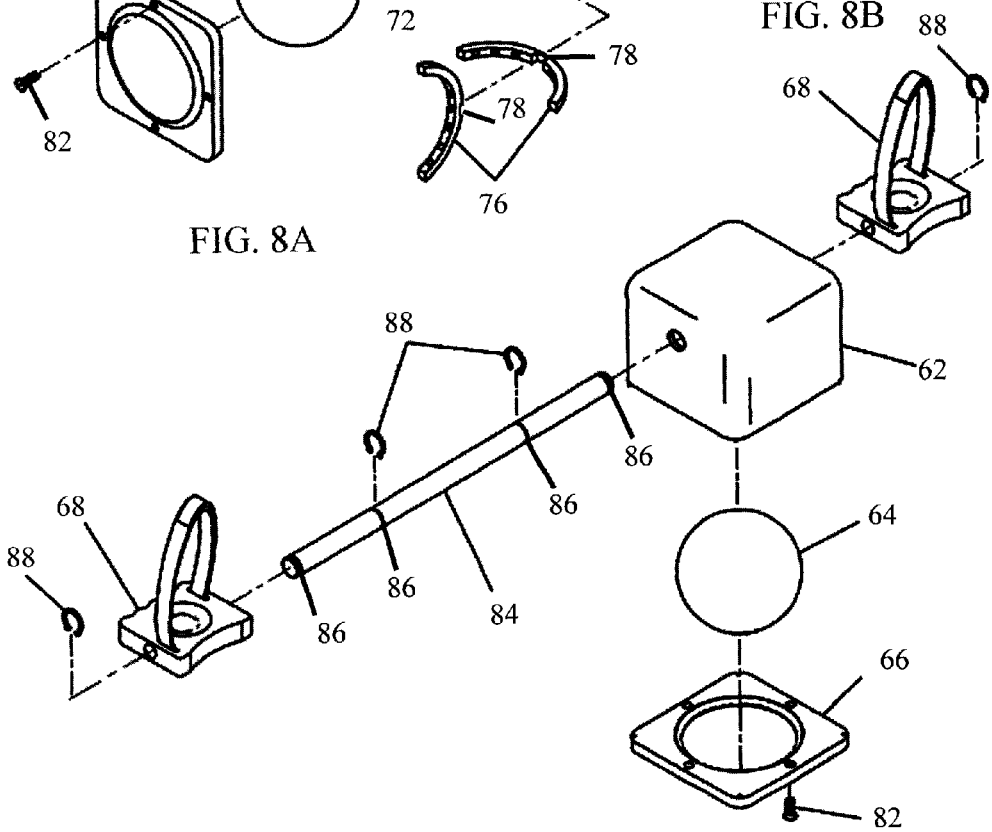
FIG. 8C is an exploded view of the exercise device of FIG. 7.
Figure 9A:
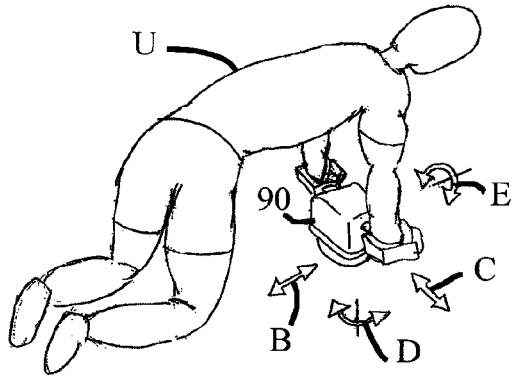
FIG. 9A is a schematic view of a user exercising with the exercise device of FIG. 1 while engaging the exercise device with his hands.
Figure 9B:
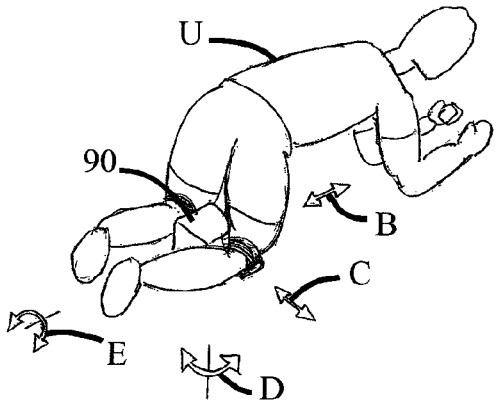
FIG. 9B is a schematic view of a user exercising with the exercise device of FIG. 1 while engaging the exercise device with his knees.
Figure 9C:
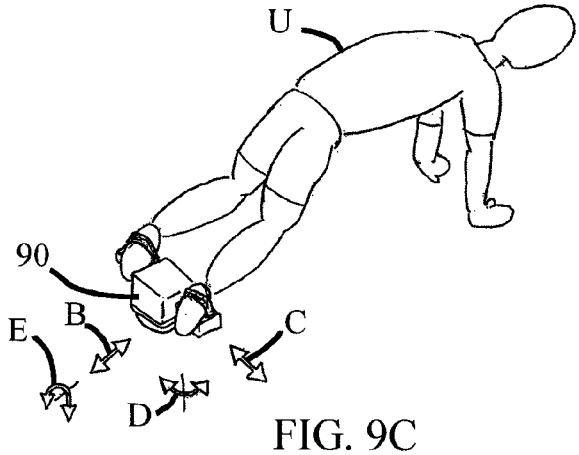
FIG. 9C is a schematic view of a user exercising with the exercise device of FIG. 1 while engaging the exercise device with his feet.

FIGS. 8A and 8C show exploded views of portions of the exercise device 60. FIG. 8B shows a perspective view of a partial assembly of the exercise device 60. Referring now to these figures, it can be seen that like the exercise device 2, the housing 62 of the exercise device 60 has a cavity 72 for receiving the support ball 64. The cavity 72 is in the shape of a partial sphere and its surface has two grooves 74. The grooves 74 are adapted to receive and retain the two ball bearing strips 76. Each of the ball bearing strips 76 has a notch 78 to permit the overlapping disposition of the ball bearing strips 76 within the grooves 74. The support ball 64 is captured within the cavity 72 by a retaining element 66 which is attached to the housing 62 by screws 82 (only one of which is shown).

The principal difference between the exercise device 60 and the exercise device 2 is that the exercise device 60 has an axle 84 which is configured as a straight rod rather than as a yoke as was the axle 10 of the exercise device 2. The axle 84 includes grooves 86 for removably receiving clips 88 for rotatably retaining the handles 68 on the axle 84.

The exercise devices of the present invention are preferably constructed of materials which are dimensioned to allow the exercise device to be used by adults, but yet lightweight enough to be conveniently transported in luggage when the user is traveling. Material and manufacturing costs also need to be considered when selecting materials of construction, with those having lower costs being preferred. The housing and retaining element may be made from metal with a good strength to weight ratio, e.g., steel or aluminum, or other materials such as wood, fiberglass, or plastic. The housing may consist of an outer shell with internal components forming the support ball-receiving cavity and support elements for the axle. More preferably, the housing is made of molded or injection molded plastic.

The axle is subjected to bending moments imparted by the user's weight applied to the handles, so needs to be made of a strong, stiff material. Metals, such as steel and aluminum, are preferred, but other materials, including stiff plastics and composite materials may be used. It is to be understood that the axle need not be made of one or even two pieces, but may be made of any convenient number of interconnected pieces. The handles described with regard to the embodiments of the inventive exercise device shown in FIGS. 1-8C have a central hollow shaft for receiving the axle, but they may comprise a portion of the axle which itself is attached to other portions of the axle by threaded connections or otherwise.

Although the handles have been described with regard to the embodiments of the inventive devices shown in FIGS. 1-8C as having support platforms and other features and being separate from the axle, it is to be understood that the handles are optional features of the present invention and the user may simply engage the portions of the axle that extend beyond the housing while using the inventive exercise device. Also, the handles in some embodiments of the present invention are simple grips that are either fixedly or rotatably located upon the portions of the axle that extend beyond the housing.

The handles may be made of monolithic material or they may comprise a plurality of materials. For example, in the inventive exercise devices shown in FIGS. 1-8C, the support platform portion of the handle is constructed of a material that has sufficient strength and stiffness to support the user's limb, e.g., a metal, hard plastic, wood, or rubber. The portion of the handle that is atop the support platform may comprise one or more cushioning materials to provide for the user's comfort during use, e.g., a foam material, which itself may be covered by a cleanable material, such as plastic or leather. Although the handles preferably include an indentation forming a receptacle for the user's kneecap or elbow and indentations on their leading edges to receive the user's fingers, these features are optional and the surfaces upon which they are located may be flat or of any configuration which would be acceptable to a user's comfort. It should also be noted that when a handle includes a hollow shaft for receiving the axle, the handle may be provided with a metal or plastic shaft-lining sleeve to minimize wear on the shaft.

The handles preferably include optional retaining straps. The straps may be of a fixed or an adjustable length and may include any conventional type of fastener, e.g., hook and loop, buckle, snap, etc. The straps may be permanently or removably attached to the handle by any conventional means. The straps may be made of any conventional strap material.

The support ball may be solid, hollow, or partially hollow. It should be made of a stiff, strong material that is capable of supporting the load imposed upon it by the bearings and the floor without indenting. The support ball may be made of a strong, stiff metal, e.g., steel, plastic rubber, or a composite material, and may be coated with a traction-enhancing material. The outer surface of the support ball should be selected so that during use the inventive exercise device does not slip on common conventional flooring surfaces. Preferably, the static coefficient of friction between the support ball surface and concrete is at least 0.5. Preferably, the support ball is a hollow steel ball having a rubber coating. The diameter of the support ball is in the range of from about 3 to about 5.5 inches and preferably in the range of from about 4 to about 5.5 inches. Diameters in these size ranges permit the inventive exercise devices to be proportioned for good portability while still providing for a floor contact tilt angle that is at least 35 degrees.

The bearings and their races may be metal or plastic and may be lubricated or self-lubricating. The bearings are also preferably ball bearings, but other types, e.g., roller bearings, may be also be used either alone or in combination with ball bearings. In the embodiments of the inventive exercise device described above with reference to FIGS. 1-8C, the bearings are described as being contained in two continuous, overlapping strips. However, the present invention also includes the use of any number of strips comprising individual bearings contained within individual races interposed between the partially spherical cavity of the housing and the support ball so long as the number of strips and their placement is sufficient to permit free-rolling support of the housing on the support ball in any direction.

The present invention also includes methods of exercising with the inventive exercise devices. In such embodiments, the inventive exercise device is rolled about a use surface while being engaged by portions of a pair of a user's limbs, e.g., the user's hands, elbows, knees, or feet. The use surface may be a floor, a wall, an incline plane, a support surface (e.g., a table top), a ceiling, or any other suitable surface.

FIGS. 8A-8C show various ways of using the inventive exercise devices. FIG. 8A shows a user U exercising while engaging the inventive exercise device 90 with his hands. The arrows B-E indicate the various directions of motion the user U may move the exercise device 90 during use, i.e., back and forth B, left and right C, circular D, and tilting E. Likewise, FIG. 8B shows the user U exercising while engaging the exercise device 90 with his knees, and FIG. 8C shows the user U exercising while engaging the exercise device 90 with his feet.

While only a few embodiments of the present invention have been shown and described, it will be obvious to those skilled in the art that many changes and modifications may be made thereunto without departing from the spirit and scope of the present invention as described in the following claims. All patent applications and patents referenced herein are incorporated herein in their entireties to the full extent permitted by law.

What is claimed is:

1. An exercise device comprising:

a support ball having a diameter in the range of from about 3 to about 5.5 inches;

a housing having a partially spherical cavity for receiving the support ball, the partially spherical cavity having a surface;

a plurality of bearing strips, each of the bearing strips comprising a bearing rotatably captured within a race;

an axle mounted within and extending through the housing and having first and second ends and a central opening with arms extending therefrom so as to be configured as a yoke; and a pair of handles, each handle being rotatably affixed to one of the first and second ends of the axle so as to be rotatable about a longitudinal axis of the axle;

wherein each of the plurality of bearing strips is affixed to the surface of the partially spherical cavity and disposed to provide free-rolling support of the housing upon the support ball and each of the handles is adapted to be engaged by a portion of a limb of a user so that the user may roll the exercise device about a use surface.

2. The exercise device of claim 1, wherein at least one of the handles has a support platform.

3. The exercise device of claim 2, wherein the support platform comprises a receptacle for receiving at least one of the user's kneecap and elbow.

4. The exercise device of claim 1, wherein at least one of the handles also comprises a strap, the strap being adapted to retain the user's limb to the handle during use of the exercise device.

5. The exercise device of claim 1, wherein the diameter of the support ball is in the range of between about 4 and about 5.5 inches.

6. The exercise device of claim 1, wherein the exercise device has a floor contact tilt angle of at least 35 degrees.

7. The exercise device of claim 1, wherein the exercise device has a floor contact tilt angle of at least 40 degrees.

8. The exercise device of claim 1, wherein the support ball has an outer surface having a static coefficient of friction with concrete of at least 0.5.

9. The exercise device of claim 1, wherein the support ball comprises a rubber coating.

10. The exercise device of claim 1, wherein the axle comprises a plurality of elongate members.

11. The exercise device of claim 1, further comprising a retaining element adapted to be attached to the housing so as to retain the support ball within the partially spherical cavity when the exercise device is lifted from a floor and having an aperture that is sized to permit the support ball to cleanly extend therethrough during use of the exercise device.

12. A method of exercising comprising:

providing an exercise device to a user, wherein the exercise device comprises a support ball having a diameter in the range of from about 3 to about 5.5 inches;

a housing having a partially spherical cavity for receiving the support ball, the partially spherical cavity having a surface;

a plurality of bearing strips, each of the bearing strips comprising a bearing rotatably captured within a race;

an axle mounted within and extending through the housing and having first and second ends and a central opening with arms extending therefrom so as to be configured as a yoke; and a pair of handles, each handle being rotatably affixed to one of the first and second ends of the axle so as to be rotatable about a longitudinal axis of the axle;

wherein each of the plurality of bearing strips is affixed to the surface of the partially spherical cavity and disposed to provide free-rolling support of the housing upon the support ball and each of the handles is adapted to be engaged by a portion of a limb of a user so that the user may roll the exercise device about a use surface;

the user engaging the exercise device with a pair of limbs; and the user rolling the exercise device about the use surface.

13. The method of claim 12, wherein the use surface is at least one selected from a floor, a wall, a ceiling, a support surface, and an incline plane.

14. The method of claim 12, wherein the step of engaging the exercise device with a pair of limbs includes engaging the exercise device with at least one selected from the user's hands, the user's elbows, the user's knees, and the user's feet.

15. The method of claim 12, wherein at least one of the handles comprises a support platform.

16. The method of claim 12, wherein the exercise device has a floor contact tilt angle of at least 35 degrees.

* * * * *